US006663356B2

(12) United States Patent
Ota et al.

(10) Patent No.: US 6,663,356 B2
(45) Date of Patent: Dec. 16, 2003

(54) CONTROL VALVE FOR VARIABLE DISPLACEMENT TYPE COMPRESSOR

(75) Inventors: Masaki Ota, Kariya (JP); Tatsuya Hirose, Kariya (JP); Kazuya Kimura, Kariya (JP); Ken Suitou, Kariya (JP); Satoshi Umemura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/948,345

(22) Filed: Sep. 7, 2001

(65) Prior Publication Data

US 2002/0031432 A1 Mar. 14, 2002

(30) Foreign Application Priority Data

Sep. 8, 2000 (JP) ..... 2000-273823

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS

| | | | | | |
|---|---|---|---|---|---|
| 4,570,451 | A | * | 2/1986 | Langouet | 62/228.3 |
| 5,205,718 | A | * | 4/1993 | Fujisawa et al. | 417/222.2 |
| 6,164,925 | A | * | 12/2000 | Yokomachi et al. | 417/222.2 |
| 6,336,335 | B2 | * | 1/2002 | Ota et al. | 123/198 R |
| 6,371,734 | B1 | * | 4/2002 | Ota et al. | 417/222.2 |
| 6,382,926 | B2 | * | 5/2002 | Ota et al. | 417/222.2 |
| 6,385,979 | B2 | * | 5/2002 | Ota et al. | 62/115 |
| 6,386,834 | B1 | * | 5/2002 | Kimura et al. | 417/222.2 |
| 2001/0002237 | A1 | * | 5/2001 | Ota et al. | 417/222.2 |
| 2001/0008131 | A1 | * | 7/2001 | Ota et al. | 123/339.17 |
| 2001/0013225 | A1 | * | 8/2001 | Ota et al. | 62/228.5 |
| 2001/0014287 | A1 | * | 8/2001 | Ota et al. | 417/213 |
| 2001/0027658 | A1 | * | 10/2001 | Ota et al. | 62/228.3 |
| 2001/0027659 | A1 | * | 10/2001 | Ota et al. | 62/228.3 |
| 2001/0052236 | A1 | * | 12/2001 | Ota et al. | 62/228.3 |
| 2001/0055531 | A1 | * | 12/2001 | Ota et al. | 417/222.2 |
| 2002/0004011 | A1 | * | 1/2002 | Suitou et al. | 417/222.2 |
| 2002/0011074 | A1 | * | 1/2002 | Suitou et al. | 62/228.3 |
| 2002/0031432 | A1 | * | 3/2002 | Ota et al. | 417/222.2 |
| 2002/0035842 | A1 | * | 3/2002 | Suitou et al. | 62/228.3 |
| 2002/0037223 | A1 | * | 3/2002 | Suitou et al. | 417/222.2 |
| 2002/0064467 | A1 | * | 5/2002 | Ota et al. | 9/948 |

FOREIGN PATENT DOCUMENTS

| | | | |
|---|---|---|---|
| JP | 4-350372 | 12/1992 | F04B/49/00 |
| JP | 5-133326 | 5/1993 | F04B/27/08 |
| JP | 6-341378 | 12/1994 | F04B/49/00 |
| JP | 11-324930 | 11/1999 | F04B/49/00 |
| JP | 2000-9044 | 1/2000 | F04B/49/06 |

* cited by examiner

*Primary Examiner*—Cheryl J. Tyler
*Assistant Examiner*—William H. Rodriguez
(74) *Attorney, Agent, or Firm*—Morgan & Finnegan, LLP

(57) ABSTRACT

A control valve is used for a variable displacement compressor. The compressor has a crank chamber and a bleed passage. The control valve includes a valve housing. A valve chamber is defined in the valve housing. A valve body is accommodated in the valve chamber for adjusting the opening size of the bleed passage. A pressure sensing chamber is defined in the valve housing. A pressure sensing member separates the pressure sensing chamber into a first pressure chamber and a second pressure chamber. The pressure at a first pressure monitoring point is applied to the first pressure chamber. The pressure at a second pressure monitoring point located is applied to the second pressure chamber. The pressure sensing member moves the valve body in accordance with the pressure difference between the first pressure chamber and the second pressure chamber such that the displacement of the compressor is varied to counter changes of the pressure difference. The pressure sensing member is a bellows or a diaphragm.

9 Claims, 4 Drawing Sheets

CONTROL VALVE FOR VARIABLE DISPLACEMENT TYPE COMPRESSOR

BACKGROUND OF THE INVENTION

The present invention relates to a control valve used for a displacement variable compressor incorporated in a refrigerant circuit of an air-conditioning system for controlling the discharge displacement of the variable displacement type compressor, which can change the discharge displacement in accordance with the pressure in the crank chamber.

Japanese Unexamined Patent Publication No. 6-341378 discloses such a control. This control valve mechanically detects the pressure difference between two pressure monitoring points, which are located in a refrigerant circuit, and adjusts the pressure in a crank chamber by determining the position of a valve body in accordance with a force that acts on the spool, based on the pressure difference.

In the control valve, the spool is displaced by sliding along the inner wall of a pressure sensing chamber according to the fluctuations of the pressure difference. Therefore, the sliding resistance between the spool and the inner wall of the pressure sensing chamber or a foreign particle caught in the sliding portion hinders the smooth movement of the spool. Accordingly, the fluctuations of the pressure difference is not promptly reflected on the opening size of the valve and the discharge displacement of the compressor. As a result, the cooling performance of the associated air-conditioning system deteriorates.

Accordingly, it is required to perform surface treatment such as smooth grinding and to form a low-friction coating to reduce the sliding resistance between the spool and the inner wall of the pressure sensing chamber. Alternatively, a filter must be provided in the control valve to remove foreign particles. As a result, the cost of the control valve increases.

SUMMARY OF THE INVENTION

The objective of the present invention is to provide an inexpensive control valve for a variable displacement type compressor that can promptly change the opening size of a valve according to the fluctuations of the pressure difference between two pressure monitoring points.

To achieve the foregoing objective, the present invention provides a control valve used for a variable displacement compressor installed in a refrigerant circuit of a vehicle air conditioner. The refrigerant circuit has a suction pressure zone. The compressor varies the displacement in accordance with the pressure in a crank chamber. The compressor has a bleed passage, which connects the crank chamber to the suction pressure zone. The control valve comprises a valve housing. A valve chamber is defined in the valve housing to form a part of the bleed passage. A valve body is accommodated in the valve chamber for adjusting the opening size of the bleed passage. A pressure sensing chamber is defined in the valve housing. A pressure sensing member separates the pressure sensing chamber into a first pressure chamber and a second pressure chamber. The pressure at a first pressure monitoring point located in the refrigerant circuit is applied to the first pressure chamber. The pressure at a second pressure monitoring point located in the refrigerant circuit is applied to the second pressure chamber. The pressure sensing member moves the valve body in accordance with the pressure difference between the first pressure chamber and the second pressure chamber such that the displacement of the compressor is varied to counter changes of the pressure difference. The pressure sensing member is a bellows or a diaphragm.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve CV of a swash plate type variable displacement compressor that is provided in a vehicle air-conditioning system according to a first embodiment of the present invention will now be described with reference to FIGS. 1 and 2.

Figure 1:
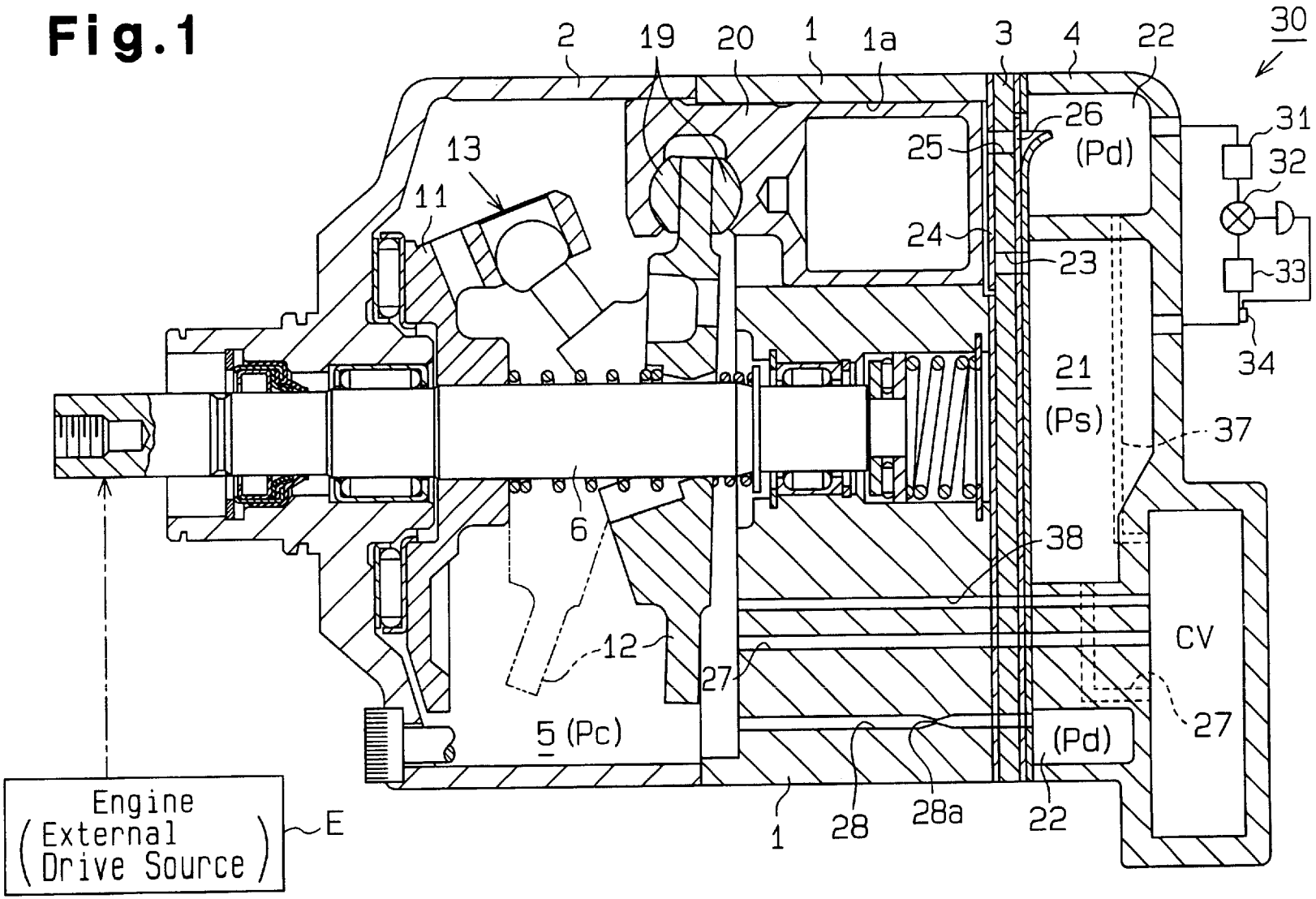
FIG. 1 is a cross-sectional view of a swash plate type variable displacement compressor according to a first embodiment.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1. The front housing member 2, the cylinder block 1 and the rear housing member 4 form a housing of the compressor.

A crank chamber 5 is defined between the cylinder block 1 and the front housing member 2. A drive shaft 6 extends through the crank chamber 5, rotatably supported. The drive shaft extends the swash plate 12 and supports the swash plate 12. The drive shaft 6 is connected to an engine E of the vehicle. A lug plate 11 is fixed to the drive shaft 6 in the crank chamber 5 to rotate integrally with the drive shaft 6.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores 1*a* (only one is shown in FIG. 1) at constant angular intervals around the drive shaft 6. Each cylinder bore 1*a* accommodates a single headed piston 20 such that the piston can reciprocate in the bore 1*a*. In each bore 1*a* is defined a compression chamber, the volume of which varies in accordance with the reciprocation of the piston 20. The front end of each piston 20 is connected to the periphery of the swash plate 12 through a pair of shoes 19. As a result, the rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a*, a suction port 23, a suction valve 24 for opening and closing the suction port 23, a discharge port 25, and a discharge valve 26 for opening and closing the discharge port 25. The suction chamber 21 communicates with each cylinder bore 1*a* through the corresponding suction port 23, and each cylinder bore 1*a* communicates with the discharge chamber 22 through the corresponding discharge port 25.

When the piston 20 in a cylinder bore 1*a* moves from its top dead center position to its bottom dead center position, the refrigerant gas in the suction chamber 21 flows into the cylinder bore 1*a* through the corresponding suction port 23 and the corresponding suction valve 24. When the piston 20 moves from its bottom dead center position toward its top dead center position, the refrigerant gas in the cylinder bore 1*a* is compressed to a predetermined pressure, and it forces the corresponding discharge valve 26 to open. The refrigerant gas is then discharged through the corresponding discharge port 25 and the corresponding discharge valve 26 into the discharge chamber 22.

Figure 2:
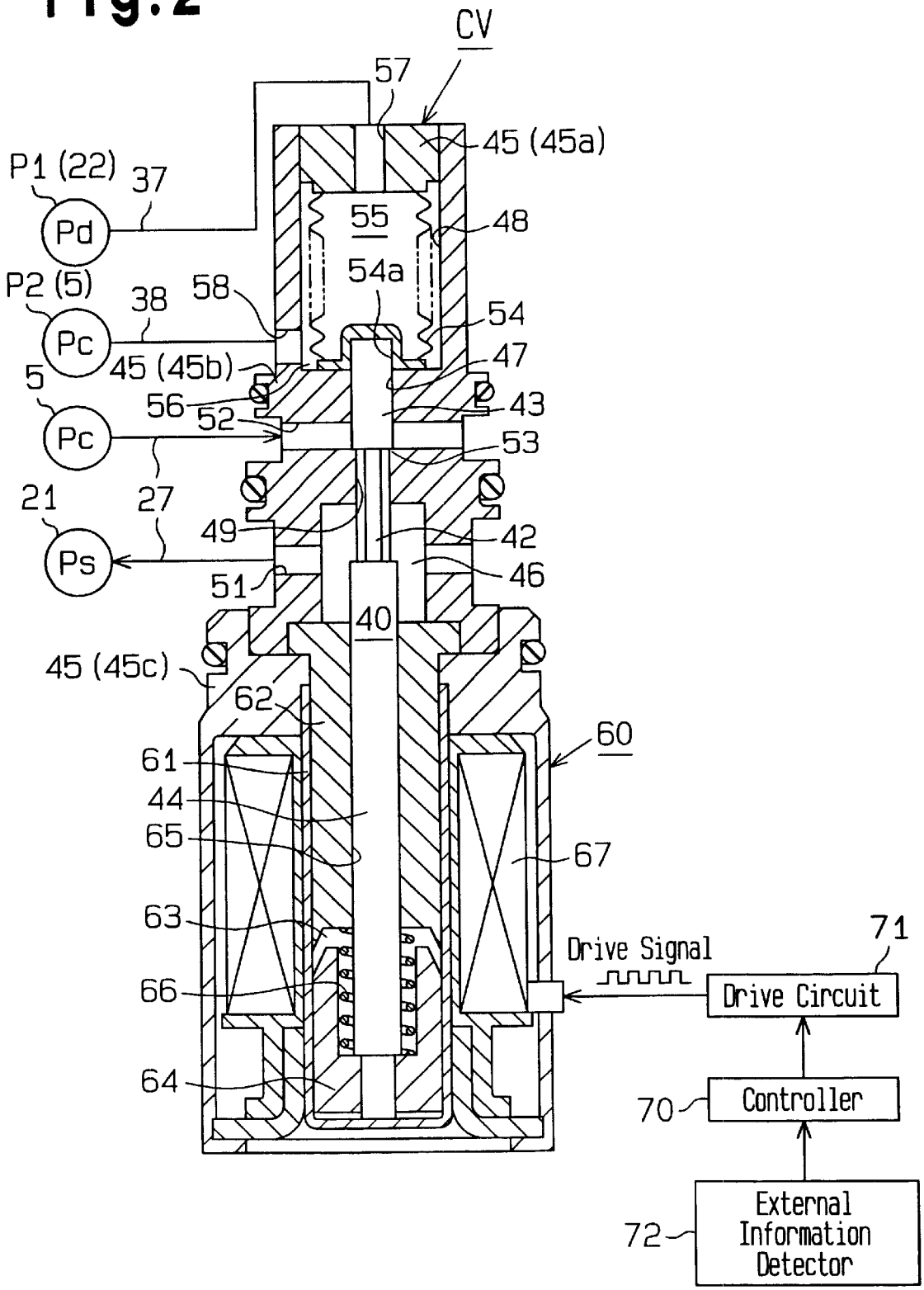
FIG. 2 is a cross-sectional view of the control valve provided in the compressor of FIG. 1.

A mechanism for controlling the pressure of the crank chamber 5 (a crank chamber pressure Pc) includes a bleed passage 27, a supply passage 28 and the control valve CV as shown in FIGS. 1 and 2. The passages 27, 28 are formed in the housing. The bleed passage 27 connects the suction chamber 21 as a suction pressure zone with the crank chamber 5. The control valve CV is located in the bleed passage 27. The supply passage 28 connects the discharge chamber 22 as a discharge pressure zone with the crank chamber 5. A fixed restrictor 28*a* is located in the supply passage 28.

The control valve CV changes the opening size of the bleed passage 27 to adjust the flow rate of refrigerant gas from the crank chamber 5 to the suction chamber 21. The crank pressure Pc is changed in accordance with the relationship between the flow rate of refrigerant gas from the discharge chamber 22 to the crank chamber 5 and the flow rate of refrigerant gas flowing out from the crank chamber 5 to the suction chamber 21 through the bleed passage 27. The difference between the crank chamber pressure Pc and the pressure in the cylinder bores 1*a* is changed in accordance with the crank chamber pressure Pc, which varies the inclination angle of the swash plate 12. This alters the stroke of each piston 20 and the compressor displacement.

FIG. 1 illustrates a refrigerant circuit of the vehicle air-conditioning system. The refrigerant circuit has a swash plate type variable displacement compressor and an external refrigerant circuit 30. The external refrigerant circuit 30 connects the discharge chamber 22 to the suction chamber 21. The external refrigerant circuit 30 includes, for example, a condenser 31, an expansion valve 32 and an evaporator 33. The opening of the expansion valve 32 is feedback-controlled based on the temperature detected by a heat sensitive tube 34 at the outlet of the evaporator 33 and the evaporating pressure. The expansion valve 32 supplies refrigerant, the amount of which corresponds to the thermal load, to the evaporator 33 to regulate the flow rate.

The evaporator 33, the suction chamber 21, the cylinder bores 1*a*, the discharge chamber 22, and the condenser 31 form the main circuit of the refrigerant circuit. A section of the refrigerant circuit for controlling displacement, that is, the discharge chamber 22, the supply passage 28, the crank chamber 5, the bleed passage 27, and the suction chamber 21, forms the sub-circuit of the refrigerant circuit.

As shown in FIG. 2, the control valve CV includes a bleed side valve portion and a solenoid portion 60. The bleed side valve portion controls the opening size of the bleed passage 27 connecting the suction chamber 21 with the crank chamber 5. The solenoid portion 60 as an external controlling means serves as an electromagnetic actuator for controlling an operation rod 40 provided in the control valve CV based on the level of an externally supplied current. The operation rod 40 has a valve body portion 43 at its one end, a guide portion 44 at its the other end, and a connecting portion 42, which join the valve body portion 43 with the guide portion 44.

A valve housing 45 of the control valve CV includes a cap 45*a*, an upper-half body 45*b*, and a lower-half body 45*c*. A valve chamber 46 and a communication passage 47 are defined in the upper-half body 45*b*. A pressure sensing chamber 48 is defined between the upper-half body 45*b* and the cap 45*a*. The valve chamber 46 and the communication passage 47 are connected through a valve hole 49. The cross-sectional area of the valve hole 49 is smaller than that of the communication passage 47.

The operation rod 40 is located in the valve chamber 46, the valve hole 49 and the communication passage 47 such that the operation rod 40 moves in the axial direction of the control valve CV (vertical direction in FIG. 2). The valve chamber 46 communicates with the communication passage 47 selectively in accordance with the position of the operation rod 40. The communication passage 47 is isolated from the pressure sensing chamber 48 by the valve body portion 43 of the operation rod 40.

The upper end face of a fixed iron core 62 serves as the bottom wall of the valve chamber 46. A port 51, which extends radially from the valve chamber 46, connects the valve chamber 46 with the suction chamber 21 through a downstream part of the bleed passage 27. A port 52 extending radially from the communication passage 47 connects the communication passage 47 with the crank chamber 5 through an upstream part of the bleed passage 27. Thus, the port 51, the valve chamber 46 the valve hole 49, the communication passage 47, and the port 52 serve as part of the bleed passage 27, which connects the suction chamber 21 with the crank chamber 5 and serves as the control passage.

The valve body portion 43 of the operation rod 40 is located in the communication passage 47. A step between the communication passage 47 and the valve hole 49 functions as a valve seat 53. In the position shown in FIG. 2 (the lowest position), the valve body portion 43 contacts the valve seat 53 so that the valve hole 49 is closed. When the operation rod 40 moves upward from the lowest position, the valve hole 49 opens and the valve chamber 46 and the communication passage 47 are connected. The valve body portion 43 of the operation rod 40 functions as a bleed side valve body, which selectively adjusts the opening size of the bleed passage 27.

A tubular pressure sensing member 54, which has a closed end, is accommodated in the pressure sensing chamber 48. The pressure sensing member 54 is a bellows in this embodiment. The pressure sensing member 54 is made of metal material such as copper. The upper end portion of the pressure sensing member 54 is secured to the cap 45*a* of the valve housing 45 by, for example, welding. The pressure sensing member 54 defines a first pressure chamber 55 and a second pressure chamber 56 in the pressure sensing chamber 48.

An accommodating portion 54*a* is formed at the bottom wall portion of the pressure sensing member 54. The distal end of the valve body portion 43 of the operation rod 40 is inserted in the accommodating portion 54*a*. The pressure sensing member 54 is elastically deformed during its installation. The pressure sensing member 54 is pressed against the valve body portion 43 through the accommodating portion 54*a* by a force based on elasticity. The amount of initial elastic deformation of the pressure sensing member 54 during the installation can be changed according to the degree of press fitting of the cap 45*a* in the upper-half body 45*b*.

The first pressure chamber 55 is connected to the discharge chamber 22, in which a first pressure monitoring point P1 is located, through a first port 57 formed in the cap 45*a* and a first pressure detecting passage 37. The second pressure chamber 56 is connected to a crank chamber 5, which is a second pressure monitoring point P2, through a second port 58, which extends through the upper-half body 45*b*, and a second pressure detecting passage 38. The pressure of the first pressure monitoring point P1, which is the discharge pressure Pd, is applied to the first pressure chamber 55. The pressure of the second pressure monitoring point P2, which is the crank chamber pressure Pc, is applied to the second pressure chamber 56.

The solenoid portion 60 includes an accommodating cylinder 61 having a closed end. A fixed iron core 62 is fitted in the accommodating cylinder 61. A solenoid chamber 63 is defined in the accommodating cylinder 61. A movable iron core 64 is located in the solenoid chamber 63 to be movable in the axial direction. A guide hole 65, which extends in the axial direction, is formed at the center of the fixed iron core 62. The guide portion 44 of the operation rod 40 is located in the guide hole 65 to be movable in the axial direction. The bottom end of the guide portion 44 is secured to the movable iron core 64 in the solenoid chamber 63. Therefore, the movable iron core 64 and the operation rod 40 move vertically as a unit.

A return spring 66, which is formed of a coil spring, is accommodated between the fixed iron core 62 and the movable iron core 64 in the solenoid chamber 63. The return spring 66 urges the operation rod 40 downward in FIG. 2 such that the movable iron core 64 is separated from the fixed iron core 62.

A coil 67 is wound around the fixed iron core 62 and the movable iron core 64. A drive signal is supplied to the coil 67 from a drive circuit 71. The drive signal is supplied based on a command from a controller 70 in accordance with the external information from the external information detector 72. The external information includes the temperature of the passenger compartment of the vehicle and a target temperature. The coil 67 generates the electromagnetic force between the movable iron core 64 and the fixed iron core 62 corresponding to the level of supplied current. The current value that is supplied to the coil 67 is controlled by adjusting the applied voltage to the coil 67. The duty control is used for adjusting the applied voltage in this embodiment.

The opening size of the control valve CV of the first embodiment is determined by the position of the operation rod 40.

When no current is supplied to the coil 67, or when duty ratio is zero percent, the downward force of the pressure sensing member 54 and the return spring 66 position the rod 40 at the lowest position shown in FIG. 2. Thus, the valve body portion 43 closes the valve hole 49. Therefore, the crank chamber pressure Pc is the maximum, which increases the difference between the crank chamber pressure Pc and the pressure in the cylinder bore 1*a*. Accordingly, the inclination angle of the swash plate 12 is the minimum, which minimizes the discharge displacement of the compressor.

When a current having the minimum duty ratio is supplied to the coil 67 (the minimum duty ratio is greater than zero percent), the upward electromagnetic force exceeds the downward force of the pressure sensing member 54 and the return spring 66. Thus, the operation rod 40 moves upward. The upward electromagnetic force, which is directed oppositely to the downward force of the return spring 66, counters the downward force of the pressure difference between the two pressure monitoring points P1 and P2 (pressure difference $\Delta P = Pd - Pc$) In this case, the downward force of the pressure difference acts in the same direction as the downward force of the pressure sensing member 54. The valve body portion 43 of the operation rod 40 is positioned with respect to the valve seat 53 such that the upward force and the downward force are balanced.

When the rotational speed of the engine E decreases, which decreases the discharge displacement of the compressor per unit of time, the discharge pressure Pd drops, which causes the downward force based on the pressure difference $\Delta P$ to decrease. Accordingly, the forces applied to the operation rod 40 are not balanced. Therefore, the operation rod 40 moves upward, thus compressing the pressure sensing member 54 and the return spring 66. The valve body portion 43 of the operation rod 40 is positioned such that the resulting increase in the downward forces of the pressure sensing member 54 and the spring 66 compensates for the reduction in the downward force based on the lower pressure difference $\Delta P$. As a result, the opening size of the valve hole 49, that is, the opening size of the control valve CV, increases, which decreases the crank chamber pressure Pc. Accordingly, the difference between the crank chamber pressure Pc and the pressure in each cylinder bore 1*a* decreases. Thus, the inclination angle of the swash plate 12 increases, which increases the discharge displacement of the compressor. When the discharge displacement of the compressor increases, the discharge pressure Pd increases, which increases the pressure difference $\Delta P$.

On the other hand, when the rotational speed of the engine E increases, which increases the discharge displacement per unit of time of the compressor, the discharge pressure Pd increases, which increases the downward force based on the pressure difference $\Delta P$. Accordingly, the forces applied to the operation rod 40 are not balanced. Therefore, the operation rod 40 moves downward, and the pressure sensing member 54 and the return spring 66 expand. The valve body portion 43 of the operation rod 40 is positioned such that the resulting decrease in the downward forces of the pressure sensing member 54 and the return spring 66 compensates for the increase in the downward force based on the greater pressure difference $\Delta P$. As a result, the opening size of the valve hole 49 decreases, which increases the crank chamber pressure Pc. Accordingly, the difference between the crank chamber pressure Pc and the pressure in each cylinder bore 1*a* increases. Thus, the inclination angle of the swash plate 12 decreases, which decreases the discharge displacement of the compressor. When the discharge displacement of the compressor decreases, the discharge pressure Pd decreases, which decreases the pressure difference $\Delta P$.

When the duty ratio of the current that is supplied to the coil 67 increases, which increases the electromagnetic force, balance of the various forces is not achieved by the pressure difference ΔP. Therefore, the operation rod 40 moves upward so that the pressure sensing member 54 and the return spring 66 are compressed. The valve body portion 43 is positioned such that the resulting increase in the downward forces of the pressure sensing member 54 and the spring 66 compensates for the increase in the upward electromagnetic force. Therefore, the opening size of the valve hole 49 is increased, which increases the discharge displacement of the compressor. As a result, the discharge pressure Pd increases, which also increases the pressure difference ΔP.

When the duty ratio of the current that is supplied to the coil 67 decreases, which decreases the electromagnetic force, balance of the various forces is not achieved by the pressure difference ΔP at the time. Therefore, the operation rod 40 moves downward, and the pressure sensing member 54 and the return spring 66 expand. The valve body portion 43 is positioned such that the decrease in the downward force of the pressure sensing member 54 and the spring 66 compensates for the decrease in the upward electromagnetic force. Therefore, the opening size of the valve hole 49 is decreased, which decreases the discharge displacement of the compressor. As a result, the discharge pressure Pd decreases, which also decreases the pressure difference ΔP.

As described above, the control valve CV of this embodiment positions the operation rod 40 according to the fluctuations of the pressure difference ΔP at the time. The control valve CV maintains the target value of the pressure difference ΔP, which is determined by the duty ratio of the current that is supplied to the coil 67. The target value of the pressure difference ΔP is changed by adjusting the duty ratio of the current that is supplied to the coil 67. The pressure difference ΔP fluctuates if the crank chamber pressure Pc varies even when the discharge pressure Pd is constant. However, the crank chamber pressure Pc is far smaller than the discharge pressure Pd. Thus, the crank chamber pressure Pc is deemed to be substantially constant.

The first embodiment provides the following advantages.

The pressure sensing member 54 is displaced according to the fluctuations of the pressure difference ΔP without sliding along the inner wall of the pressure sensing chamber 48. Therefore, the operation rod 40 is displaced promptly and accurately in accordance with the fluctuations of the pressure difference ΔP. Accordingly, there is no need to perform surface treatment, as in the prior art, to reduce the sliding resistance between a spool and the inner wall of the pressure sensing chamber 48. It is also not necessary to provide a filter on each pressure detecting passage 37 and 38 to remove foreign particles. Thus, the cost of the control valve CV is reduced.

The pressure difference, which is the base for the adjusting operation of the opening size of the control valve CV, can be adjusted by changing the duty ratio of the current that is supplied to the coil 67. Therefore, compared with a control valve that has no electromagnetic structure (an external control means) or a control valve that only allows a single target pressure difference, the control valve CV of the present invention can be more finely controlled.

The control valve CV adjusts the pressure in the crank chamber 5 by regulating the bleed passage 27. The control valve CV changes the opening size of the bleed passage 27. Therefore, the amount of refrigerant gas that is supplied to the crank chamber 5 from the discharge chamber 22 can always be minimized by the fixed restrictor 28*a* in the supply passage 28. In other words, the amount of compressed refrigerant gas that leaks into the crank chamber 5 can be minimized. Compared with a control valve that regulates the supply passage 28, the invention reduces the deterioration of the efficiency of the refrigerant cycle caused by re-expansion of the compressed refrigerant gas in the compressor. This leads to low fuel consumption of the engine E.

The control valve CV does not directly receive the discharge pressure Pd for adjusting the pressure in the crank chamber 5. Therefore, the pressure-resistant structures and the sealing structures at the passages 52, 47, 49, 46, and 51 in the housing 45 of the control valve CV are simplified.

The present invention may be modified as follows.

Figure 3:
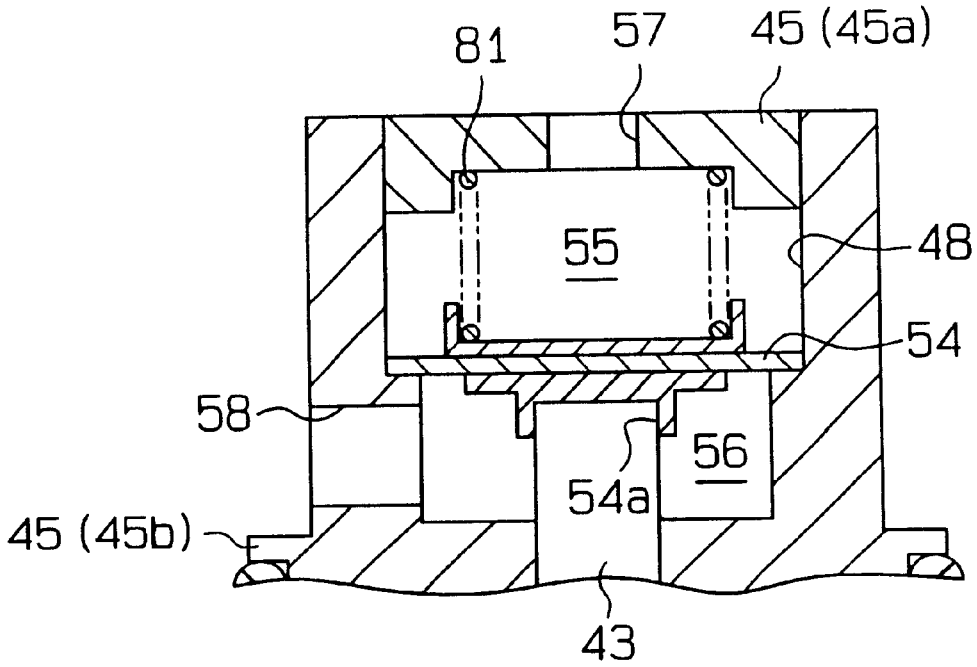
FIG. 3 is an enlarged partial cross-sectional view illustrating a control valve according to a second embodiment of the present invention.

According to a second embodiment as shown in FIG. 3, a diaphragm may be used as the pressure sensing member 54. In the second embodiment, the pressure sensing member 54 and a separate spring 81, which function as the pressure sensing member 54 in FIG. 2, are located between the cap 45*a* and the pressure sensing member 54.

Figure 4:
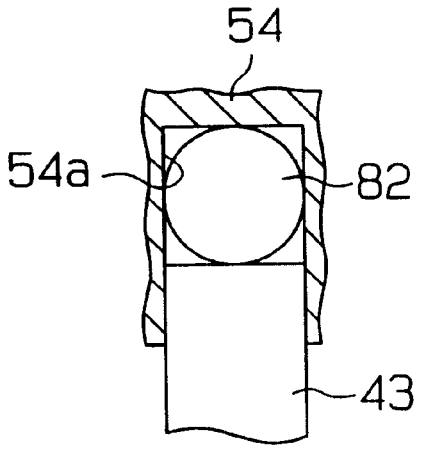
FIG. 4 is an enlarged partial cross-sectional view illustrating a control valve according to a third embodiment of the present invention.

According to a third embodiment shown in FIG. 4, a ball 82 may be provided in the accommodating portion 54*a* of the pressure sensing member 54 in the embodiments shown in FIG. 2 or 3. In this case, the pressure sensing member 54 and the valve body portion 43 of the operation rod 40 contact each other through the ball 82. Even when the pressure sensing member 54 is tilted with respect to the axial direction of the operation rod 40, the ball 82 aligns the load to be transmitted in the axial direction of the operation rod 40 from the pressure sensing member 54 to the operation rod 40. Thus, the invention prevents the opening size of the control valve CV from being different from the desired value due to tilting of the valve body portion 43 of the operation rod 40.

Figure 5:
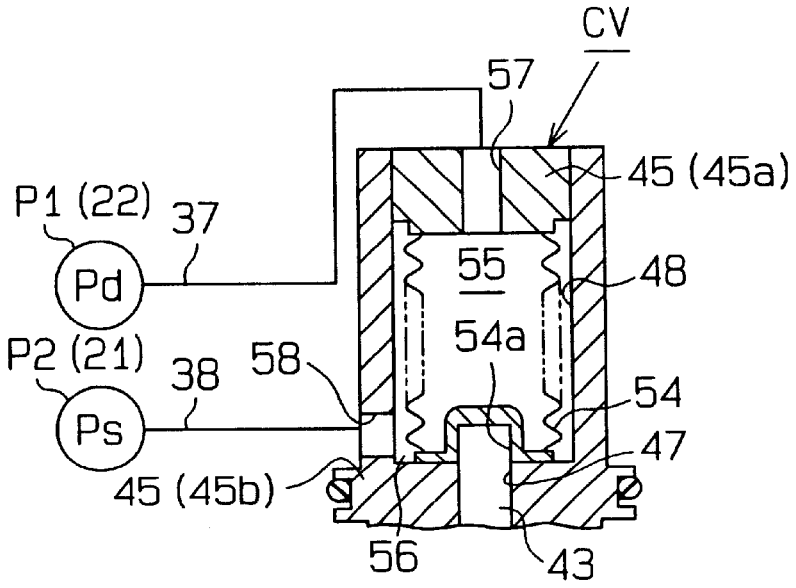
FIG. 5 is an enlarged partial cross-sectional view illustrating a control valve according to a fourth embodiment of the present invention.

According to a fourth embodiment shown in FIG. 5, the first pressure monitoring point P1 may be located in the discharge pressure zone (the discharge chamber 22 in FIG. 5) between the discharge chamber 22 and the condenser 31 of the refrigerant circuit. The second pressure monitoring point P2 may be located in the suction pressure zone (the suction chamber 21 in FIG. 5) between the evaporator 33 and the suction chamber 21 of the refrigerant circuit.

Figure 6:
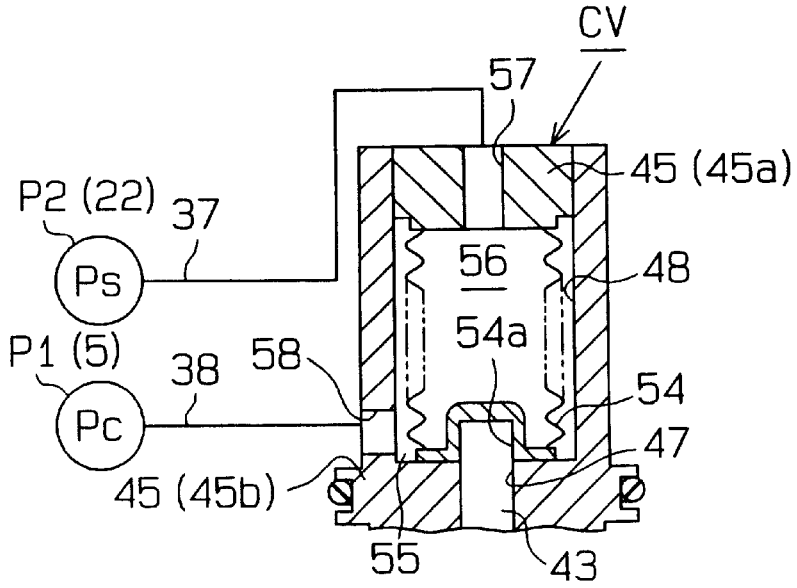
FIG. 6 is an enlarged partial cross-sectional view illustrating a control valve according to a fifth embodiment of the present invention.

According to a fifth embodiment shown in FIG. 6, the first pressure monitoring point P1 may be located in the crank chamber 5. The second pressure monitoring point P2 may be located in the suction pressure zone (the suction chamber 21 in FIG. 6) between the evaporator 33 and the suction chamber 21 of the refrigerant circuit. In the fifth embodiment, the internal space of the pressure sensing member 54 is equivalent to the second pressure chamber 56. The space between the inner wall of the pressure sensing chamber 48 and the pressure sensing member 54 is equivalent to the first pressure chamber 55. Therefore, in the fifth embodiment, the operating direction of the force based on the pressure difference ΔP is reversed compared with the embodiments shown in FIGS. 1 to 5. For example, the increased duty ratio (electromagnetic force) of the current that is supplied to the coil 67 decreases the target pressure difference.

It should be apparent to those skilled in the art that the present invention may be embodied in many other specific forms without departing from the spirit or scope of the invention. Particularly, it should be understood that the invention may be embodied in the following forms.

The first pressure monitoring point P1 may be located in the discharge pressure zone between the discharge chamber 22 and the condenser 31 of the refrigerant circuit. The second pressure monitoring point P2 may be located downstream of the first pressure monitoring point P1 at the same discharge pressure zone.

The first monitoring point P1 may be located in the suction pressure zone between the evaporator 33 and the suction chamber 21. The second pressure monitoring point P2 may be located downstream of the first pressure monitoring point P1 at the same suction pressure zone.

The present invention may be embodied in an air-conditioning system that has a wobble plate type variable discharge compressor.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit of a vehicle air conditioner, wherein the refrigerant circuit has a suction pressure zone, wherein the compressor varies the displacement in accordance with the pressure in a crank chamber, and the compressor has a bleed passage, which connects the crank chamber to the suction pressure zone, the control valve comprising:

a valve housing;

a valve chamber defined in the valve housing to form a part of the bleed passage;

a valve body, which is accommodated in the valve chamber for adjusting the opening size of the bleed passage;

a pressure sensing chamber defined in the valve housing; and a pressure sensing member, which separates the pressure sensing chamber into a first pressure chamber and a second pressure chamber, wherein the pressure at a first pressure monitoring point located in the refrigerant circuit is applied to the first pressure chamber, and the pressure at a second pressure monitoring point located in the refrigerant circuit is applied to the second pressure chamber, wherein the pressure sensing member moves the valve body in accordance with the pressure difference between the first pressure chamber and the second pressure chamber such that the displacement of the compressor is varied to counter changes of the pressure difference, and wherein the pressure sensing member is a bellows or a diaphragm.

2. The control valve according to claim 1 further comprising an actuator for applying force to the pressure sensing member in accordance with external commands, wherein the force applied by the actuator corresponds to a target value of the pressure difference, wherein the pressure sensing member moves the valve body such that the pressure difference seeks the target value.

3. The control valve according to claim 2, wherein the actuator is a solenoid, which applies force in accordance with a supplied electrical current.

4. The control valve according to claim 1, wherein the refrigerant circuit has a discharge pressure zone, wherein the first pressure monitoring point is located in the discharge pressure zone, and wherein the second pressure monitoring point is located in the suction pressure zone or the crank chamber.

5. The control valve according to claim 1, wherein the first pressure monitoring point is located in the crank chamber, and wherein the second pressure monitoring point is located in the suction pressure zone.

6. The control valve according to claim 1, wherein a ball is located between the pressure sensing member and the valve body.

7. The control valve according to claim 1, wherein the refrigerant circuit has a discharge pressure zone, wherein the first and second pressure monitoring points are located in the discharge or suction pressure zone.

8. The control valve according to claim 1, wherein the pressure sensing member separates and seals the first and second pressure chambers from each other.

9. The control valve according to claim 1, wherein a part of the pressure sensing member is fixed to the valve housing, and wherein the pressure sensing member separates the first and second pressure chambers from each other.

* * * * *